252-104 AU 115 EX
7/7/87 XR 4,678,518

United States Patent [19]
Ayukawa et al.

[11] Patent Number: 4,678,518
[45] Date of Patent: Jul. 7, 1987

[54] NON-AQUEOUS DEGREASING AND CHROMATING SOLUTION FOR METAL TREATMENT

[75] Inventors: Nobuhiro Ayukawa; Yasuhiko Konishi, both of Kanagawa, Japan

[73] Assignee: Nippon Dacro Shamrock Co., Ltd., Yokohama, Japan

[21] Appl. No.: 753,789

[22] Filed: Jul. 11, 1985

[30] Foreign Application Priority Data

Jul. 25, 1984 [JP] Japan ..... 59-153028

[51] Int. Cl.[4] ..... B08B 3/08; C07C 17/42; C11D 7/50; C23G 5/02

[52] U.S. Cl. ..... 148/6.2; 106/14.05; 134/40; 148/6.14 A; 252/100; 252/104; 252/143; 252/147; 252/170; 252/171; 570/117

[58] Field of Search ..... 148/6.2, 6.14 A; 106/14.05; 134/40; 252/100, 104, 143, 147, 170, 171; 570/117

[56] References Cited

U.S. PATENT DOCUMENTS

| | | | |
|---|---|---|---|
| 2,819,193 | 1/1958 | Rausch | 148/6.14 A |
| 3,285,788 | 11/1966 | Svadlenak | 148/6.2 |
| 3,382,081 | 5/1968 | Cutter | 106/14.05 |
| 3,630,789 | 12/1971 | Deyrup | 148/6.2 |
| 3,706,336 | 12/1972 | Bride | 204/51 |
| 4,257,828 | 3/1981 | Wada | 148/6.16 |

FOREIGN PATENT DOCUMENTS

| | | | |
|---|---|---|---|
| 362956 | 12/1931 | United Kingdom | 148/6.14 A |

*Primary Examiner*—Dennis L. Albrecht
*Attorney, Agent, or Firm*—Webb, Burden, Robinson & Webb

[57] ABSTRACT

A non-aqueous chromating treatment solution comprising a chlorofluorocarbon solvent, chromic acid anhydride, an alcohol solubilizer, and an organic carboxylic acid reaction promotor gives a higher coating amount of chromate film and better corrosion resistance effect.

2 Claims, No Drawings

NON-AQUEOUS DEGREASING AND CHROMATING SOLUTION FOR METAL TREATMENT

FIELD OF THE INVENTION

This invention relates to a novel liquid composition for treating metal surfaces. More particularly, this invention relates to a metal surface treatment agent which comprises a single solution containing chlorofluorocarbon solvent, chromic acid anhydride, solubilizer, reaction promoter, etc., and is able to effect degreasing and chromating treatment simultaneously.

BACKGROUND OF THE INVENTION

There are known single solution metal surface treatment agents which comprise an organic solvent, a chromating agent or phosphoric acid and a chromating agent, a solubilizer and a stablizer and/or a reaction promotor and are able to effect degreasing and surface treatment simultaneously.

These agents comprise an organic solvent as a degreaser in which a surface treatment agent is solubilized by means of a solubilizer such as an alcohol andor a surfactant and contain other additives. As the organic solvent, chlorinated hydrocarbon, fluorochlorinated hydrocarbon, alcohols etc. are used.

Japanese Patent Publication No. 3363/67 (Du Pont), Japanese Patent Publication No. 5288/65 (Du Pont), Japanese Laid-Open Patent Publication No. 62970/81 (Tokuyama Soda), etc. disclose those treatment agents containing chlorinated hydrocarbon solvent and chromating agent; and Japanese Laid-Open Patent Publication No. 97476/80 (Nippon Paint), Japanese Laid-Open Patent Publication No. 112479/80 Nippon Paint) and Japanese Laid-Open Patent Publication No. 139679/81 (Nippon Paint) disclose compositions containing phosphoric acid and chromic acid.

These known treatment agents using chlorinated hydrocarbon solvents are, however, liable to decompose, which causes the treating bath to become unstable, the corrosion resistance of the treated articles to be insufficient, and the equipment to be corroded, etc. Therefore, when these solvents are used, several kinds of stabilizers are usually added in order to prevent decomposition thereof. However, these stabilizers react with chromic acid and impair the effect thereof, and this results in decomposition and degradation of the treating solution causing corrosion of the equipment and degraded corrosion resistance of the resulting treated articles. Under the circumstances, chromating treatment compositions using chlorinated hydrocarbon solvent are not in practical use today.

The compositions disclosed in the above mentioned Japanese laid-open patent publications of Nippon Paint contain chlorofluorocarbon solvents. However, the compositions disclosed there are phosphate treatment solutions for surface preparation to which chromic acid is added. They contain only limited amounts of chromic acid, which is nothing but an auxiliary agent for phosphate treatment in these compositions.

In order to eliminate the above-mentioned defects of the above described non-aqueous chromate treatment agents, we conducted an intensive study, and, by incorporating an organic carboxylic acid in a chlorofluorocarbon solvent, we have created a very stable substantially nonaqueous chromating treatment liquid composition, which gives chromate film having very good corrosion resistance with high coating weight.

This invention relates to a metal surface treating liquid composition comprising chlorofluorocarbon, chromic acid anhydride, a solubilizer and an organic carboxylic acid.

SUMMARY OF THE INVENTION

This invention provides a metal surface treating liquid composition comprising 100 parts by weight of a chlorofluorocarbon solvent, 0.01–10 parts by weight of chromic acid anhydride, 0.001–0.1 part by weight of an organic carboxylic acid containing 1–20 carbon atoms and an alcohol solubilizer containing 3–20 carbon atoms.

The chlorofluorocarbon solvents used in this invention contain 1 or 2 carbon atoms, fluorine atoms and chlorine atoms, and no hydrogen atoms, and trichloromonofluoromethane, dichlorotetrafluoroethane, trichlorotrifluoroethane, tetrachlorodifluoroethane and mixtures thereof are preferred. In selecting the chlorofluorocarbon solvent, the most important factors are that it must be miscible with the other components to form a homogeneous solution and the solution be able to exist as a liquid at a temperature at which chromating reaction can proceed at a significant reaction rate.

Chromic acid anhydride used in this invention is chromium trioxide, that is, a compound represented by the formula $CrO_3$. Said chromic acid anhydride is added to the chlorofluorocarbon solvent in an amount of 0.01–10 parts by weight, preferably 0.5–5 parts by weight, more preferably 0.5–3 parts by weight per 100 parts by weight of said solvent. With chromic acid anhydride of less than about 0.01 part by weight, the chromating reaction is too slow whereas with chromic acid anhydride content of more than about 10 parts by weight, decomposition of the solvent in the chromating bath becomes remarkable, there arises a tendency that normal chromate film is not formed and corrosion resistance of the resulting coating becomes poor.

The solubilizer used in this invention is a secondary or tertiary alcohol having 3–20 carbon atoms which is soluble in the above-described chlorofluorocarbon solvent. Generally, secondary propanol, tertiary butanol, tertiary amyl alcohol, triphenyl carbinol, etc. are suitably used. Of these, tertiary butanol (referred to as t-butanol hereinafter) is most preferred because it solubilizes all the ingredients homogeneously, is stable over a long period of use of the composition and is inexpensive. The solubilizer is used in an amount of at least 1 part by weight per 100 parts by weight of the chlorofluorocarbon solvent. Twenty (20) parts by weight or more can be used. With a larger amount of the solubilizer, a larger amount of chromic acid anhydride dissolves. When the amount of the solubilizer is less than 1 part by weight, the solubilizing power is insufficient and homogeneous dissolution of the ingredients is difficult. More than 20 parts by weight can be used, but in such a case the composition may become inflammable depending upon conditions of use. Therefore, the content thereof is preferably limited to not more than this value.

The reaction promotor used in this invention is an organic carboxylic acid having 1–20 carbon atoms which is soluble in the mixture of the above described ingredients. A carboxylic acid of the general formula $R\text{-}(COOH)_n$, wherein R is a straight-chained, branched, cyclic or aromatic hydrocarbyl group, which may have substituents, can be used. Those is which n is 1–3 are preferred. Examples of preferred organic acids are formic acid, acetic acid, butyric acid, lactic acid, stearic acid, oxalic acid, fumaric acid, maleic acid, malic acid, phthalic acid, etc.

The amount of the carboxylic acid to be added is preferably 0.001–0.1 part by weight, more preferably 0.005–0.05 part by weight. With less than about 0.001 part by weight of the carboxylic acid, little or no reaction promotion effect is exhibited. With more than about 0.1 part by weight, the acid becomes to exhibits etching effect, and it dissolves the formed chromate film, thus prevents formation of a protective film, and poor corrosion resistance results.

As the reaction promotor, hydrogen fluoride, etc. have heretofore been used. However, hydrogen fluoride does not exhibit remarkable reaction-promoting activity in the compositon of this invention, but it exerts etching effect on the articles to be treated as well as the equipment. Therefore this substance is disadvantageous in that it must be used with extreme care.

The treating liquid composition of this invention can be obtained by mixing the above mentioned essential ingredients—chlorofluorocarbon solvent, chromic acid anhydride, solubilizer, and reaction promotor—in desired amounts respectively within the above-defined ranges to form a homogeneous solution. The chlorofluorocarbon solvent acts as a degreasing agent, and makes the composition incombustible, and the solubilizer is essential for the homogeneous dissolution of all the ingredients. Water can be incorporated within the range that it is homogeneously miscible with the other ingredients. The homogeneously dissolved water promotes dissolution of chromic acid anhydride and accelerates the chromating reaction. The chromating treatment liquid composition must be a homogeneous solution in which all the ingredients are homogeneously dissolved. Otherwise, a uniform coating film is not formed resulting in an insufficient anti-corrosion effect.

The liquid composition of this invention is applicable to iron, steel, aluminum, zinc, tin and these metals existing in combination. It is especially effective for zin, aluminum and these metals in combination. The term "combination" used herein encompasses both composites or alloys of these metals.

The metal surface treatment liquid composition of this invention can be stored at room temperature for a long period of time.

When used, the metal treatment liquid composition of this invention is kept at a temperature between 5° C. and the boiling temperature thereof, and the metallic material to be treated is contacted therewith for 1 second to 60 minutes, preferably 30 seconds to 5 minutes. Thereafter the surface of the metallic material is dried. If the treatment liquid composition is colder than 5° C., the chromating reaction does not substantially proceed. If the contact time is shorter than 1 second, a substantially effective coating film is not obtained. A contact time longer than 60 minutes does not give a uniform film, and it is not desirable from the viewpoint of productivity. The metallic materials to be treated should preferably be degreased and cleaned beforehand, as there is a limit to the amount of grease that can be removed with the treatment liquid composition of this invention during chromating treatment.

The main effects brought about by the invention as described above are that the stabilizing agent which was essential for conventional metal surface treatment compositions, in which chlorinated hydrocarbon was the main ingredient, is not required and that the coating weight of chromium is markedly increased with the advantages of the conventional metal surface treatment compositions retained.

EMBODIMENTS OF THE INVENTION

The invention will now be explained in detail by way of working examples and comparative examples. In these working and comparative example, stability of treatment liquid composition and the coating amount of the chromate film of treated articles were determined as follows.

Stability of treatment liquid composition: A predetermined amount of a treatment liquid composition is taken in a vessel, water is added and the mixture is agitated well and is allowed to stand. To the separated upper layer (aqueous phase), a potassium iodide solution, acetic acid and a starch solution are added and agitated. After the aqueous phase has been kept in a dark place for about 5 minutes, development of blue color is checked. When the color does not appear, it is taken to indicate no decomposition. This is a general method for checking decomposition of chlorinated and chlorofluorinated hydrocarbons.

Coating amount of chromate film (as chromium): Determined by a fluorescent X-ray analyser (manufactured by Pitchford Co.). As chromium is also detected from untreated materials, the blank test values are subtracted from the measured counts.

COMPARATIVE EXAMPLE 1

A treatment liquid composition was prepared by homogeneously dissolving 15 parts t-butanol and 2 parts chromic acid anhydride in 100 parts trichlorotrifluoroethane. This solution was heated to the boiling temperature and test panels were immersed therein for reaction. The treated panels were tested for coating amount of chromium, and corrosion resistance thereof was determined by the salt spray test (JIS Z 2371). The test panels were rectangles of cold-rolled steel sheets (50×70×0.8 mm) the surface of which was electrolytically plated with zinc up to 8 μm in thickness. The results are shown in Table 1.

COMPARATIVE EXAMPLE 2

The procedure of Comparative Example 1 was repeated with a treatment liquid composition to which 0.01 part hydrogen fluoride was added. The results are shown in Table 1. The coating amount of chromate film increased only slightly.

COMPARATIVE EXAMPLE 3

The coating amount of chromate film and corrosion resistance in the salt spray test of commercially available test panels which were electrolytically zinc-plated 8 μm thick, and treated with the known aqueous chromating solution were determined in the same manner. The results are shown in Table 1.

COMPARATIVE EXAMPLE 4

A treatment liquid composition was prepared by homogeneously dissolving 15 parts t-butanol, 2 parts chromic acid anhydride, 0.005 part zinc fluoride and 1 part parabenzoquinone in 100 parts methylene chloride. The solution was kept at its boiling point for 24 hours and the stability of the solution was checked. Strong blue color appeared and liberation of chlorine due to decomposition of methylene chloride was revealed.

EXAMPLE 1

A treatment solution was prepared by homogeneously dissolving 15 parts t-butanol, 2 parts chromic acid anhydride and 0.01 part oxalic acid in 100 parts trichlorotrifluoroethane. The solution was heated to its boiling temperature and test panels were immersed therein for reaction. The coating amount of chromium and the corrosion resistance in the salt spray test were checked. The test panels were 8 μm thick rectangles of electrolytically zinc-plated cold-rolled steel 50×70×0.8 mm. The reslults are shown in Table 1.

EXAMPLE 7

The procedure of Example 1 was repeated with isopropanol instead of t-butanol and acetic acid instead of oxalic acid, and the result as indicated in Table 1 was obtained.

EXAMPLE 8

The procedure of Example 1 was repeated with t-amyl alcohol instead of t-butanol and 0.01 part butyric acid instead of oxalic acid, and the result as indicated in Table 1 was obtained.

TABLE 1

| Example No. | Reaction Promotor Compound | Reaction Promotor Amount (parts) | Chromic Acid Anhydride (parts) | Solubilizer | (parts) | Temp. of Treatment (°C.) | Coating Amount of Chromium (counts) | Salt Spray Test (hrs) |
|---|---|---|---|---|---|---|---|---|
| Comparative 1 | — | — | 2 | t-Butanol | 15 | 46.7° C. (b.p.) | 9800 | 210 |
| Comparative 2 | Hydrogen fluoride | 0.01 | " | " | | " | 10500 | 220 |
| Comparative 3 | — | — | — | — | | — | 24200 | 240 |
| Working 1 | Oxalic acid | 0.01 | 2 | t-Butanol | 15 | 46.7° C. (b.p.) | 20800 | 336 |
| Working 2 | Oxalic acid | 0.005 | " | " | | " | 16300 | 264 |
| Working 3 | Fumaric acid | 0.01 | " | " | | " | 22100 | 336 |
| Working 4 | Fumaric acid | 0.05 | " | " | | 40° C. | 24800 | 350 |
| Working 5 | Fumaric acid | 0.01 | 0.5 | " | | 46.7° C. (b.p.) | 12400 | 240 |
| Working 6 | Formic acid | 0.01 | 2 | " | | 10° C. | 14800 | 260 |
| Working 7 | Acetic acid | 0.01 | " | sec-Propanol | 15 | 46.7° C. (b.p.) | 19600 | 288 |
| Working 8 | Butyric acid | 0.01 | " | t-Amyl alcohol | 15 | " | 17100 | 216 |
| Working 9 | Lactic acid | 0.01 | " | t-Butanol | 15 | " | 22900 | 312 |
| Working 10 | Stearic acid | 0.01 | " | " | | " | 12000 | 216 |

Solvent: 100 parts trichlorotrifluoroethane in all examples
Treatment time: 5 minutes
Salt spray test: Time until generation of red rust In comparison with Comparative Example 1, the coating amount of chromium was remarkably increased to the same level as the coating amount obtained in the aqueous chromating treatment, and the corrosion resistance of the treated articles was very satisfactory.

EXAMPLE 2

The procedure of Example 1 was repeated with 0.005 part oxalic acid, and the results as indicated in Table 1 was obtained. The coating amount of chromate film was increased.

EXAMPLE 3

The procedure of Example 1 was repeated with 0.01 part fumaric acid instead of oxalic acid, and the result as indicated in Table 1 was obtained. The coating amount of chromate film and the corrosion resistance were enhanced.

EXAMPLE 4

The procedure of Example 3 was repeated with 0.05 part fumaric acid and at 40° C., and the result as indicated in Table 1 was obtained.

EXAMPLE 5

The procedure of Example 3 was repeated with 0.5 part chromic acid anhydride and the result as indicated in Table 1 was obtained.

EXAMPLE 6

The procedure of Example 1 was repeated with 0.01 part formic acid at 10° C., and the result as indicated in Table 1 was obtained.

EXAMPLE 9

The procedure of Example 1 was repeated with 0.01 part lactic acid instead of oxalic acid, and the result as indicated in Table 1 was obtained.

EXAMPLE 10

The procedure of Example 1 was repeated with 0.01 part stearic acid instead of oxalic acid, and the result as indicated in Table 1 was obtained.

As is apparent from the above description, when metallic materials are treated with the metal surface treatment liquid composition of this invention, the coating amount of chromate film is markedly increased and the corrosion resistance is enhanced in comparison with the case when they are treated with a conventional treatment solution with chlorofluorocarbon solvent and without a reaction promotor. It was revealed that the prior art reaction promotor, hydrogen fluoride, is not always remarkably effective. Further when compared with commercially available zinc-plated panels chromated with conventional aqueous chromating systems, coating amount of chromate film of the same level is secured and the resulting corrosion resistance is superior to or of the same level.

EXAMPLE 11

Panels of a cold-rolled sheet and an aluminum (1080) sheet were treated in accordance with the procedure of Example 1, and the results were compared with those of untreated panels. The results are summarized in Table 2.

TABLE 2

| Example No. | Substrate Metal | Coating Amount of Chromium (counts) | Salt Spray Test |
|---|---|---|---|
| Working Ex. 11-1 | Iron | 3,000 | Red rust after 72 hrs. |
| Comparative Ex. 5 | " | — | Red rust after 15 mins. |
| Working Ex. 11-2 | Aluminum | 3,200 | White rust after 300 hrs. |
| Comparative Ex. 6 | " | | White rust after 24 hrs. |

Comparative Examples: not treated

As is apparent from the above description, the treatment liquid composition is effective with respect to metals such as iron, aluminium, etc., and the corrosion resistance is remarkably enhanced.

When tetrachlorodifluoroethane and trichloromonofluoromethane was used instead of trichlorotrifluoroethane, substantially the same results were obtained.

The above described working examples are for the purpose of illustration of the invention and the invention is not limited thereto.

We claim:

1. A non-aqueous degreasing and chromating solution for metal treatment essentially consisting of 100 parts by weight of a chlorofluorocarbon solvent, containing not more than 2 carbon atoms, fluorine atoms and chlorine atoms and no hydrogen atom, 0.5–5 parts by weight of chromic acid anhydride, 0.001–0.1 part by weight of an organic carboxylic acid containing 1–20 carbon atoms represented by the general formula $R(COOH)_n$ wherein R is a straight-chained, branched or cyclic hydrocarbyl group, which may be substituted and n is an integer 1–3, and 1–20 parts by weight of an alcohol solubilizer containing 3–20 carbon atoms.

2. The non-aqueous degreasing and chromating solution according to claim 1 wherein said organic carboxylic acid is present in an amount between 0.005–0.05 parts by weight.

* * * * *